US010833401B2

(12) United States Patent
Thotahewa et al.

(10) Patent No.: US 10,833,401 B2
(45) Date of Patent: Nov. 10, 2020

(54) PHASED ARRAY ANTENNAS HAVING DECOUPLING UNITS

(71) Applicant: CommScope Technologies LLC, Hickory, NC (US)

(72) Inventors: Kasun M S Thotahewa, Dean Park (AU); Philip Raymond C. Gripo, Toongabie (AU); Peter J. Liversidge, Glenbrook (AU)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/754,565

(22) PCT Filed: Oct. 20, 2016

(86) PCT No.: PCT/US2016/057827
§ 371 (c)(1),
(2) Date: Feb. 22, 2018

(87) PCT Pub. No.: WO2017/091307
PCT Pub. Date: Jun. 1, 2017

(65) Prior Publication Data
US 2018/0248257 A1 Aug. 30, 2018

Related U.S. Application Data

(60) Provisional application No. 62/259,656, filed on Nov. 25, 2015.

(51) Int. Cl.
*H01Q 1/50* (2006.01)
*H01Q 1/52* (2006.01)
(Continued)

(52) U.S. Cl.
CPC ..... *H01Q 1/521* (2013.01); *H01Q 1/246* (2013.01); *H01Q 5/42* (2015.01); *H01Q 21/08* (2013.01); *H01Q 21/26* (2013.01); *H01Q 13/10* (2013.01)

(58) Field of Classification Search
CPC ..... H01Q 1/521; H01Q 1/246; H01Q 21/08; H01Q 13/10
See application file for complete search history.

(56) References Cited

U.S. PATENT DOCUMENTS 3,681,770 A * 8/1972 Alford ..... H01Q 21/205 343/799
4,499,474 A * 2/1985 Muhs, Jr. ..... H01Q 1/521 343/771
(Continued)

FOREIGN PATENT DOCUMENTS

CN 101662068 A 3/2010
WO 2010/018896 2/2010
(Continued)

OTHER PUBLICATIONS

International Search Report and Written Opinion of the International Searching Authority, International Application No. PCT/US2016/057827, dated Jan. 13, 2017, 15 pp.
(Continued)

*Primary Examiner* — Daniel Munoz
*Assistant Examiner* — Bamidele A Jegede
(74) *Attorney, Agent, or Firm* — Myers Bigel, P.A.

(57) ABSTRACT

A base station antenna includes a panel that has a ground plane, first and second arrays that have respective first and second sets of linearly arranged radiating elements mounted on the panel, and a decoupling unit positioned between a first radiating element of the first array and a first radiating element of the second array. The decoupling unit includes at least a first sidewall that faces the first radiating element of
(Continued)

the first array, a second sidewall that faces the first radiating element of the second array and an internal cavity that is defined in the region between the sidewalls. The first and second sidewalls are electrically conductive and electrically connected to the ground plane.

20 Claims, 10 Drawing Sheets

(51) Int. Cl.

| | |
|---|---|
| ***H01Q 1/24*** | (2006.01) |
| ***H01Q 21/08*** | (2006.01) |
| ***H01Q 5/42*** | (2015.01) |
| ***H01Q 21/26*** | (2006.01) |
| *H01Q 13/10* | (2006.01) |

(56) References Cited

U.S. PATENT DOCUMENTS

| | | | | |
|---|---|---|---|---|
| 5,548,813 | A | 8/1996 | Charas et al. | |
| 5,955,994 | A * | 9/1999 | Staker | H01Q 21/065 343/700 MS |
| 6,025,812 | A * | 2/2000 | Gabriel | H01Q 1/523 343/767 |
| 6,028,563 | A * | 2/2000 | Higgins | H01Q 1/246 343/797 |
| 6,573,875 | B2 | 6/2003 | Zimmerman et al. | |
| 6,734,829 | B1 * | 5/2004 | Gottl | H01Q 1/523 343/797 |
| 10,224,639 | B2 | 3/2019 | Chainon et al. | |
| 2001/0054983 | A1 * | 12/2001 | Judd | H01Q 1/246 343/810 |
| 2002/0101388 | A1 * | 8/2002 | Ippolito | H01Q 1/246 343/797 |
| 2002/0140618 | A1 | 10/2002 | Plet et al. | |
| 2006/0038736 | A1 * | 2/2006 | Hui | H01Q 1/243 343/835 |
| 2007/0008236 | A1 * | 1/2007 | Tillery | H01Q 21/30 343/797 |
| 2008/0094286 | A1 * | 4/2008 | Le Bayon | H01Q 1/523 343/700 MS |
| 2009/0096700 | A1 | 4/2009 | Chair | |
| 2010/0265150 | A1 * | 10/2010 | Arvidsson | H01Q 1/246 343/837 |
| 2011/0181482 | A1 * | 7/2011 | Adams | H01Q 13/18 343/771 |
| 2012/0013519 | A1 | 1/2012 | Håkansson et al. | |
| 2012/0062440 | A1 * | 3/2012 | Tasaki | H01Q 1/246 343/841 |
| 2012/0115548 | A1 * | 5/2012 | Shimizu | H01Q 21/26 455/562.1 |
| 2012/0280874 | A1 * | 11/2012 | Kim | H01Q 1/246 343/763 |
| 2013/0162496 | A1 * | 6/2013 | Wakabayashi | H01Q 21/00 343/853 |
| 2014/0085158 | A1 * | 3/2014 | Wong | H01Q 1/48 343/841 |
| 2014/0152523 | A1 | 6/2014 | Wu et al. | |
| 2014/0191042 | A1 | 7/2014 | Brown et al. | |
| 2014/0203960 | A1 * | 7/2014 | Huang | G01S 7/034 342/175 |
| 2014/0242930 | A1 * | 8/2014 | Barker | H01Q 21/08 455/129 |
| 2014/0266922 | A1 | 9/2014 | Jin et al. | |
| 2014/0266957 | A1 * | 9/2014 | Inoue | H01Q 21/08 343/843 |
| 2014/0375502 | A1 * | 12/2014 | Foo | H01Q 3/34 342/371 |
| 2015/0214613 | A1 * | 7/2015 | Backman | H01O 9/26 343/803 |

FOREIGN PATENT DOCUMENTS

| | | | |
|---|---|---|---|
| WO | WO 2010/018896 | A1 | 2/2010 |
| WO | 2015/101138 | A1 | 7/2015 |

OTHER PUBLICATIONS

Supplementary European Search Report, corresponding to EP Application No. 16 86 9038, dated Jun. 26, 2019.

Chinese Office Action corresponding to Chinese Application No. 201680053843.5, dated May 8, 2020. (English translation Only).

Examination Report corresponding to European Patent Application No. 16869038.6 (7 pages) (dated May 28, 2020).

* cited by examiner

PHASED ARRAY ANTENNAS HAVING DECOUPLING UNITS

CROSS-REFERENCE TO RELATED APPLICATIONS

This application is a 35 U.S.C. § 371 national stage application of PCT Application No. PCT/US2016/057827, filed on Oct. 20, 2016, which itself claims priority from U.S. Provisional Patent Application No. 62/259,656, filed on Nov. 25, 2015, the contents of both of which are incorporated herein by reference in their entireties. The above-referenced PCT International Application was published in the English language as International Publication No. WO 2017/091307 A1 on Jun. 1, 2017.

FIELD OF THE INVENTION

The present invention relates generally to communications systems and, more particularly, to antennas for wireless mobile communications networks.

BACKGROUND

Wireless mobile communication networks continue to evolve given the increased traffic demands on the networks, the expanded coverage areas for service and the new systems being deployed. Cellular ("wireless") communications networks rely on a network of base station antennas for connecting cellular devices, such as cellular telephones, to the wireless network. Many base station antennas include a plurality of radiating elements in a linear array. For example, U.S. Pat. No. 6,573,875, which is incorporated herein by reference, discloses a base station antenna that has a plurality of radiating elements that are arranged in an approximately vertical alignment. A feed network is provided that supplies each of the radiating elements with a sub-component of a signal that is to be transmitted. Various attributes of the antenna array, such as beam elevation angle, beam azimuth angle, and half power beam width may be determined based on the magnitude and/or phase of the signal sub-components that are fed to each of the radiating elements. The magnitude and/or phase of the signal sub-components that are fed to each of the radiating elements may be adjusted so that the base station antenna will exhibit a desired antenna coverage pattern in terms of, for example, beam elevation angle, beam azimuth angle, and half power beam width.

SUMMARY

Pursuant to embodiments of the present invention, base station antennas are provided that include a panel that has a ground plane, first and second arrays that have respective first and second sets of linearly arranged radiating elements mounted on the panel, and a decoupling unit positioned between a first radiating element of the first array and a first radiating element of the second array. The decoupling unit includes at least a first sidewall that faces the first radiating element of the first array, a second sidewall that faces the first radiating element of the second array and an internal cavity that is defined in the region between the sidewalls. The first and second sidewalls are electrically conductive and electrically connected to the ground plane.

In some embodiments, the first array may be configured to operate in a first frequency range and the second array is configured to operate in the first frequency range.

In some embodiments, the base station antenna may further include a third array that includes a third plurality of radiating elements, the third array being positioned between the first array and the second array and configured to operate in second frequency range that is different from the first frequency range. In such embodiments, the decoupling unit may be between the first radiating element of the first array and the first radiating element of the second array along a first direction and may be between a first radiating element of the third array and a second radiating element of the third array along a second direction that is substantially perpendicular to the first direction. At least one of the first and second radiating elements of the third array may vertically overlap the decoupling unit.

In some embodiments, the decoupling unit may have a generally U-shaped cross section.

In some embodiments, the first sidewall may have a lip that extends outwardly from a lower edge of the first sidewall. This lip may include a mounting aperture.

In some embodiments, the first sidewall may include a slot-shaped opening.

In some embodiments, the decoupling unit may comprise an integral metal structure.

In some embodiments, each of the first and second sidewalls may include at least one respective slot.

In some embodiments, the decoupling unit may further include a top plate that connects an upper edge of the first sidewall to an upper edge of the second sidewall. This top plate may include at least one slot.

In some embodiments, the decoupling unit may have a width in the first direction of between 0.2 and 0.35 a wavelength of a first frequency in the first frequency range where a coupling between the first and second arrays in the absence of the decoupling unit reaches a maximum value, a length in the second direction that is between 0.45 and 0.65 the wavelength of the first frequency, and a height in a third direction that is perpendicular to both the first direction and the second direction that is between 0.1 and 0.35 the wavelength of the first frequency.

In some embodiments, a height of the decoupling unit above the ground plane may be less than a height of the first radiating element of the first array above the ground plane and a height of the first radiating element of the second array above the ground plane.

Pursuant to further embodiments of the present invention, decoupling units are provided that are configured to reduce cross coupling between a first radiating element of a first linear array of a phased array antenna and a second radiating element of a second linear array of the phased array antenna. These decoupling units include a first sidewall; a second sidewall opposite the first sidewall; a top plate that connects an upper edge of the first sidewall to an upper edge of the second sidewall; and an internal cavity defined by at least the first sidewall, the second sidewall and the top plate. The top plate has a width in a first direction that extends between the first and second sidewalls of between 0.2 and 0.35 a wavelength of a first frequency in the frequency range of operation of the first radiating element where a coupling between the first and second linear arrays in the absence of the decoupling unit reaches a maximum value, the top plate has a length that is between 0.45 and 0.65 the wavelength of the first frequency, and the first and second sidewalls have a height that is between 0.1 and 0.35 the wavelength of the first frequency.

In some embodiments, the decoupling unit may have a generally U-shaped cross section.

In some embodiments, the first sidewall may have a first lip that extends outwardly from a lower edge of the first sidewall, and the second sidewall may have a second lip that extends outwardly from a lower edge of the second sidewall.

In some embodiments, the first sidewall may include a slot-shaped opening.

In some embodiments, the top plate may include at least one slot.

DETAILED DESCRIPTION

Figure 1A:
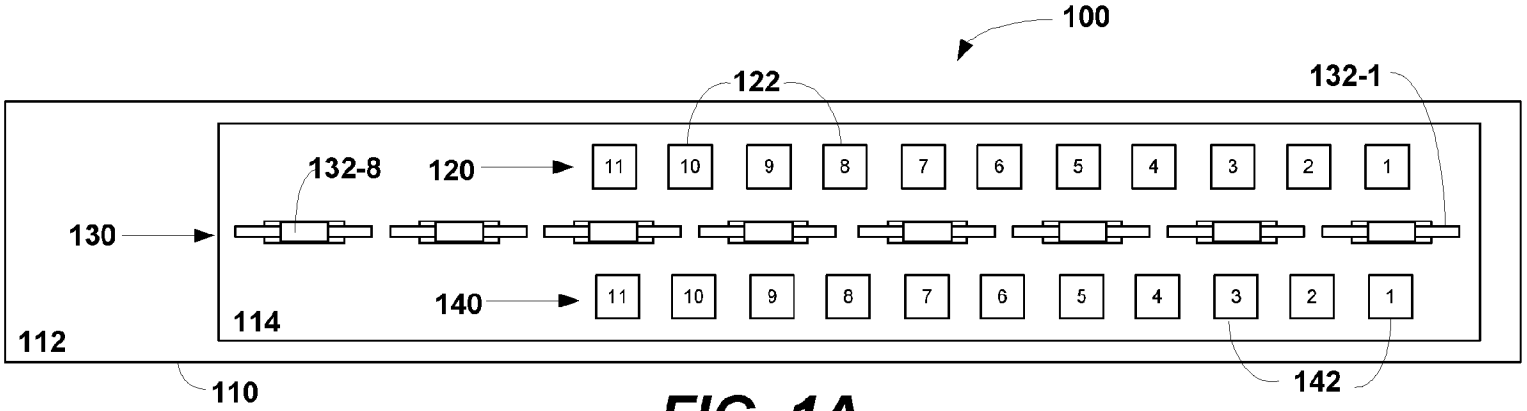
FIG. 1A (Prior Art)
FIG. 1A is a schematic front view of a conventional phased array base station antenna.

As discussed above, base station antennas are routinely implemented using phased array antennas that include a plurality of radiating elements. Often, a phased array antenna will include multiple arrays of radiating elements. The different arrays may include arrays that are connected to different types of base station equipment and that operate at different frequency bands as well as arrays that are connected to the same type of baseband equipment and that operate at the same frequency. In order to reduce the size and cost of these phased array antennas, the radiating elements are typically in close proximity. For example, a state-of-the-art phased array antenna may include three arrays of radiating elements, where each array includes between 2 and 16 elements, where all three arrays are mounted on a relatively narrow flat panel. In such a phased array antenna design, the distance between adjacent radiating elements may be, for example, as little as five centimeters.

Unfortunately, when multiple arrays of radiating elements are mounted in close proximity to each other, cross coupling may occur between the radiating elements. For example, if first and second arrays of vertically aligned radiating elements are mounted side-by-side in close proximity to each other, when signals are transmitted through one of these arrays cross coupling may occur with radiating elements of one or more of the other arrays. This cross coupling can distort the azimuth radiation patterns of the transmitting array in terms a, for example, beam width, beam squint and cross polarization. The amount of distortion will typically increase with increased cross-coupling, and hence the distortion in the antenna patterns will tend to occur at the frequencies where the cross coupling is strong. As noted above, the azimuth radiation patterns are designed to provide a desired antenna beam coverage pattern, and hence the perturbations to this pattern caused by the cross coupling may tend to reduce the performance of the base station antenna. Consequently, it may be desirable to reduce or minimize cross coupling between radiating elements of different arrays in order to improve the radiation pattern performance of the phased array base station antenna.

Pursuant to embodiments of the present invention, decoupling units are provided that may be placed between radiating elements of different arrays of a phased array antenna in order to reduce the cross coupling between the radiating elements. The decoupling unit may be mounted on, and electrically coupled to, a common ground plane for the radiating elements. In some embodiments, the decoupling unit may comprise a conductive plate that is formed in the general shape of an inverted "U" so that the decoupling unit has a top plate and a pair of sidewalls extending downwardly from the top plate. When the decoupling unit is exposed to an electromagnetic field that is generated by a radiating element of a first array that is adjacent a first side of the decoupling unit, surface currents are induced on the conductive sidewalls and top plate of the decoupling unit. The decoupling unit acts as a rectangular spatial cavity that alters the field distribution and, more specifically, reduces the strength of the electromagnetic field in the vicinity of the radiating element of a second array that is on a second, opposite, side of the decoupling unit. This reduction in near-field coupling may improve the performance of the phased array antenna.

Embodiments of the present invention will now be described in greater detail with reference to the attached drawings, in which example embodiments are depicted.

Figure 1B:
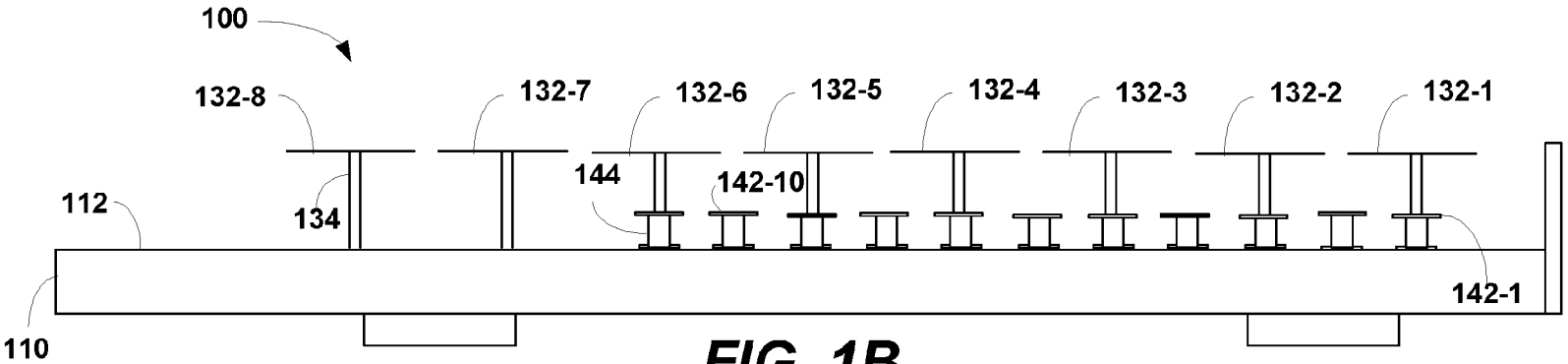
FIG. 1B (Prior Art)
FIG. 1B is a schematic side view of the conventional base station antenna of FIG. 1A.

FIG. 1A is a schematic front view of a conventional phased array base station antenna 100. FIG. 1B is a schematic side top view of the base station antenna 100 of FIG. 1A. As shown in FIGS. 1A and 1B, the phased array antenna 100 includes a panel 110 that has a plurality of radiating elements 122, 132, 142 mounted thereon. Herein, when the phased array antennas according to embodiments of the present invention include multiple of the same components, these components may be referred to individually by their full reference numerals (e.g., radiating element 132-1) and may be referred to collectively by the first part of their reference numeral (e.g., the radiating elements 132). A ground plane 114 may be mounted on a front side 112 of the panel 110. The ground plane 114 may comprise, for example, a thin conductive sheet that may cover all or a large part of the front side 112 of the panel 110. The ground plane 114 may be formed of a conductive metal such as, for example, aluminum or anther metal that is lightweight and has good electrical conductivity. The panel 110 may have a variety of different electrical and mechanical components mounted on a back side thereof (or formed therein) such as, for example, power dividers, phase shifters transmission lines, printed circuit boards and the like. A radome (not shown) will also typically be mounted to cover at least the front surface of the antenna to weatherproof and protect the radiating elements. The radome may be formed of a dielectric material such as fiberglass or plastic. As the design and operation of flat panel phased array antennas is well known to those of skill in the art, further description of the panel and these other elements will be omitted herein.

Figure 3A:
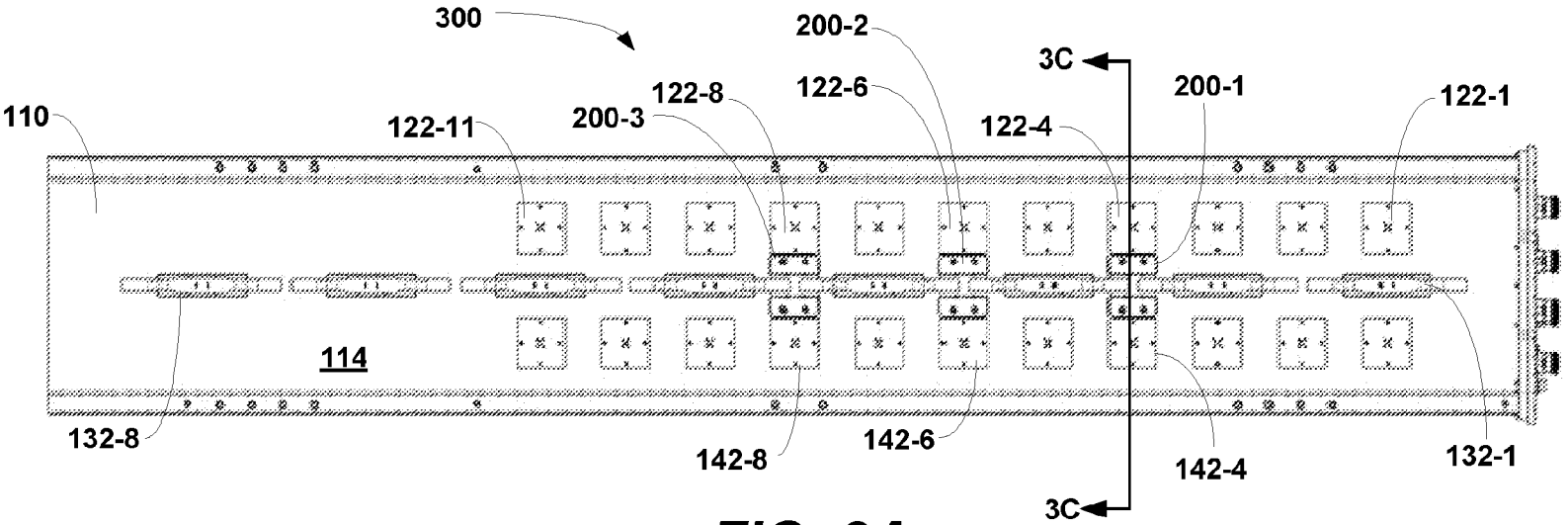
FIG. 3A is a front view of a phased array base station antenna that has three of the decoupling units of FIG. 2 mounted thereon.
Figure 3B:
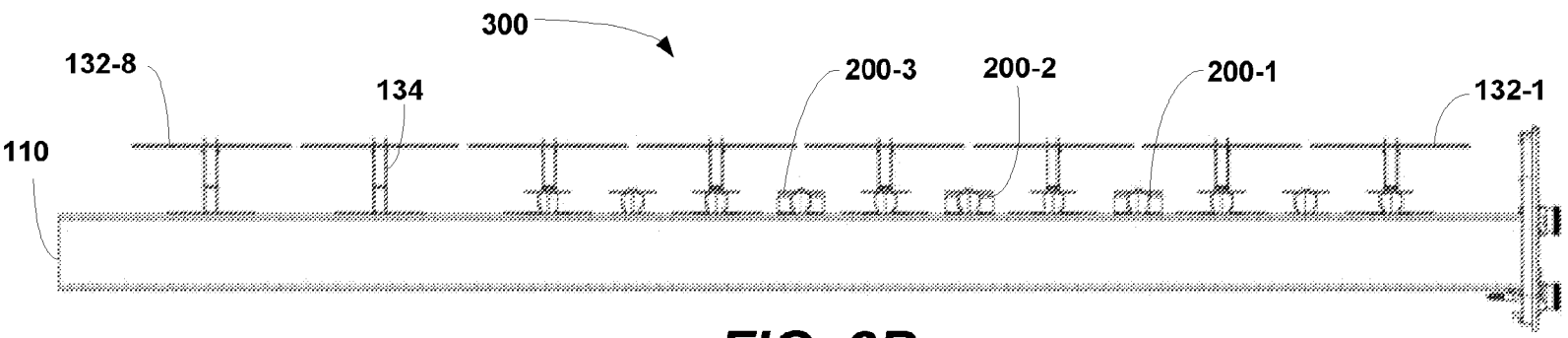
FIG. 3B is a side view of the phased array base station antenna of FIG. 3A.
Figure 3C:
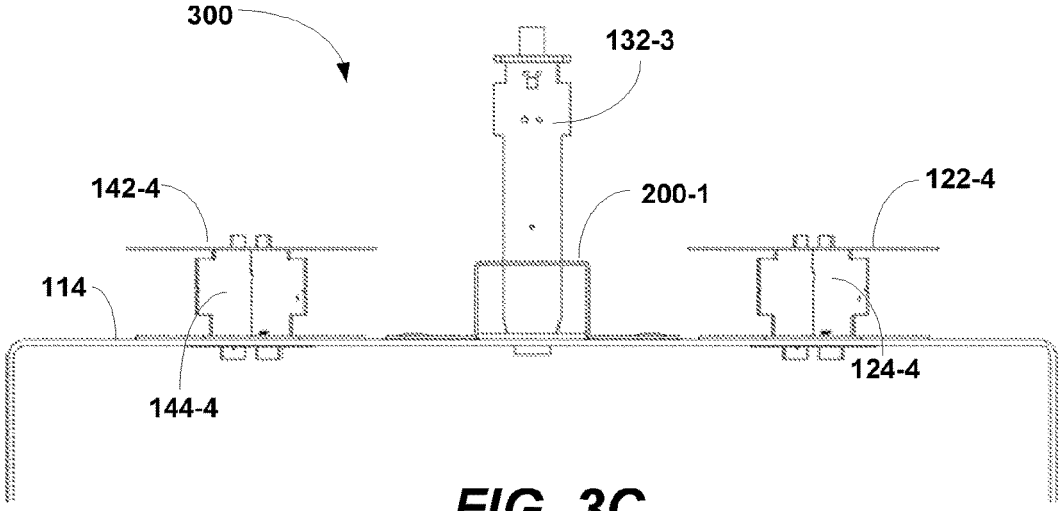
FIG. 3C is a cross-sectional view taken along line 3C-3C of FIG. 3A.

Still referring to FIGS. 1A and 1B, each radiating element 122, 132, 142 may have an associated feed structure 124, 134, 144 (the feed structures 124 are not visible in FIGS. 1A and 1B, but may be identical to the feed structures 144 and are also shown in FIG. 3C). The feed structures 124, 134, 144 may comprise transmission lines that carry RF signals to and from the radiating elements 120. The feed structures 124, 134, 144 may be used to mount the respective radiating elements 122, 132, 142 above the ground plane 114.

The radiating elements 122, 132, 142 form first through third linear arrays 120, 130, 140. The phased array antenna 100 may be mounted so that its longitudinal axis is vertically oriented, and hence each array 120, 130, 140 may comprise a vertical column of radiating elements. The first linear array 120 includes a total of eleven radiating elements 122-1 through 122-11, and is designed to operate in a first frequency range such as, for example, the 1695-2690 MHz frequency range. The second linear array 130 includes a total of eight radiating elements 132-1 through 132-8, and is designed to operate in a second frequency range that is different from the first frequency range such as, for example, the 694-960 MHz frequency range. The third linear array 140 includes a total of eleven radiating elements 142-1 through 142-11, and is designed to operate in the first frequency range (i.e., in the same frequency range as the first linear array 120). The first frequency range may be referred to herein as the "high band" and the second frequency range may be referred to herein as the 'low band" as the second frequency range is at lower frequencies than the first frequency range.

When a signal is transmitted though the radiating elements 122 of the first array 120, an electromagnetic field is generated. The electromagnetic field may extend to the radiating elements 132, 142 that are part of the other arrays 130, 140 that are adjacent thereto, and hence signal energy will cross couple to these other radiating elements 132, 142. The degree of coupling may be a function of a variety of different factors including, for example, the distance of each radiating element 122 of array 120 to the radiating elements 132, 142 of the arrays 130, 140, the amplitude of the signal transmitted by the radiating elements 122 and the designed operating frequency of the adjacent radiating elements 132, 142. Generally speaking, stronger cross coupling will occur the smaller the distance between the radiating elements and the greater the power of the signal transmitted through the radiating elements 122. Moreover, if a radiating element 122 and a closely adjacent radiating element of another array are designed to transmit in the same frequency band, the coupling tends to be stronger because both radiating elements are impedance matched to operate within the same frequency band. As discussed above, when cross coupling occurs between radiating elements of two different arrays 120, 140, the azimuth radiation pattern of the transmitting array 120 may be distorted. This distortion may, for example, change the beam width, beam squint and cross polar radiation at the frequencies where the cross coupling is relatively strong, moving these characteristics away from desired values. Consequently, it may be desirable to reduce or minimize cross coupling between adjacent radiating elements of different arrays in order to improve the radiation pattern performance of the phased array base station antenna.

Figure 2A:
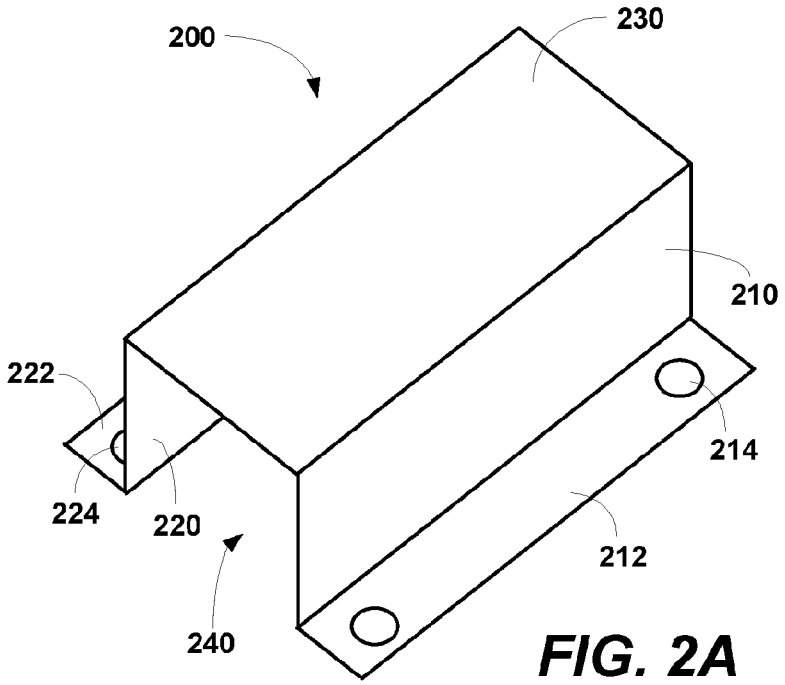
FIG. 2A is a perspective view of a decoupling unit according to embodiments of the present invention.
Figure 2B:
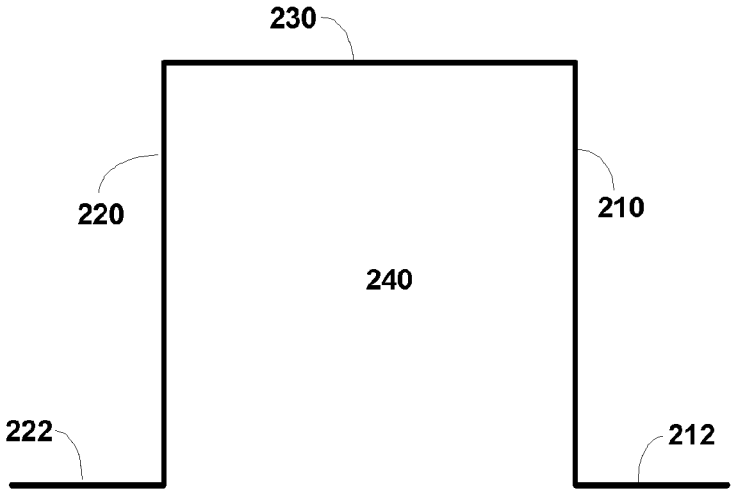
FIG. 2B is a front view of the decoupling unit of FIG. 2A.

FIG. 2A is a perspective view of a decoupling unit 200 according to embodiments of the present invention that may be used, for example, to improve the performance of the phased array antenna of FIGS. 1A-1B. FIG. 2B is a front view of the decoupling unit 200 of FIG. 2A. As shown in FIGS. 2A and 2B, the decoupling unit 200 may include a pair of sidewalls 210, 220 that at least in part define an internal cavity 240 therebetween. The decoupling unit 200 also includes a top plate 230 and lips 212, 222 that extend outwardly from the respective sidewalls 210, 220. The decoupling unit 200 has a generally inverted U-shaped cross-section as is clearly shown in FIG. 2B. The top plate 230 connects the upper edges of sidewalls 210, 220. The lips 212, 222 extend outwardly from the lower edges of the respective sidewalls 210, 220. In the depicted embodiment, the connection between each sidewall 210, 220 and the top plate 230 forms an angle of about ninety degrees, and the lips 212, 222 extend from the lower surface of the respective sidewalls 210, 220 at an angle of about ninety degrees. The lips 212, 222 may include apertures 214, 224 that may be used to mount the decoupling unit 200 to a panel of a phased array antenna using screws or the like.

The decoupling unit 200 may be formed of a conductive material such as a metal. In some embodiments, the decoupling unit 200 may be formed of a lightweight metal having good corrosion resistance and electrical conductivity such as, for example, aluminum. In the depicted embodiment, the decoupling unit 200 may be formed by stamping material from a sheet of aluminum and then forming the aluminum into the shape shown in FIG. 2A. Perforated, grate and/or mesh materials may be used in other embodiments instead of sheet metal.

Figure 3D:
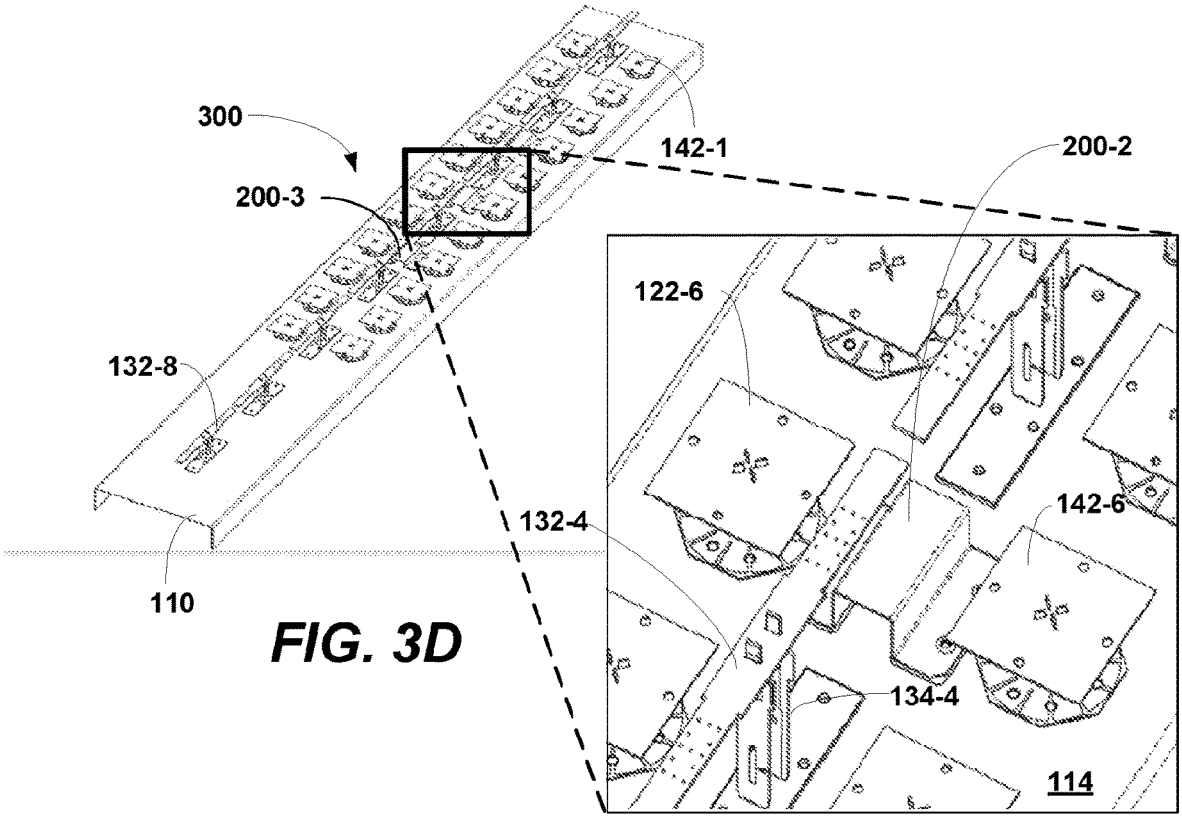
FIG. 3D is a perspective view of the phased array base station antenna of FIG. 3A with an inset providing an enlarged view of a small portion of the antenna.

FIG. 3A is a front view of a phased array base station antenna 300 according to embodiments of the present invention. The phased array base station antenna 300 comprises the phased array base station antenna 100 of FIGS. 1A-1B that has three of the decoupling units 200 of FIG. 2 mounted thereon. FIG. 3B is a side view of the phased array base station antenna 300 of FIG. 3A. FIG. 3C is a cross-sectional view of the phased array base station antenna 300 of FIG. 3A taken along line 3C-3C of FIG. 3A. FIG. 3D is a perspective view of the phased array base station antenna 300 of FIG. 3A with an inset providing an enlarged view of a small portion of the phased array antenna 300. Components of phased array antenna 300 that are the same as components of phased array antenna 100 are labelled with the same reference numerals shown in FIGS. 1A-1B.

As shown in FIGS. 3A-3D, the phased array base station antenna 300 includes a total of three of the decoupling units 200. The first decoupling unit 200-1 is positioned between radiating elements 122-4 and 142-4, the second decoupling unit 200-2 is positioned between radiating elements 122-6 and 142-6, and the third decoupling unit 200-3 is positioned between radiating elements 122-8 and 142-8. In the depicted embodiment, each decoupling unit 200 is positioned between the feed structures 134 of two of the radiating elements 132 of the second array 130. For example, decoupling unit 200-1 may be between the feed structures 134 of radiating elements 132-2 and 132-3, decoupling unit 200-2 may be between the feed structures 134 of radiating elements 132-3 and 132-4, and decoupling unit 200-3 may be between the feed structures 134 of radiating elements 132-4 and 132-5. The decoupling units 200 may be underneath the radiating elements 132 as can be seen in FIGS. 3B and 3C and in the inset in FIG. 3D. The first sidewall 210 of each of the decoupling units 200 faces a respective one of the radiating elements 122 of the first array 120, and the second sidewall 220 of each of the decoupling units 200 faces a respective one of the radiating elements 142 of the third array 140.

Each decoupling unit 200 is mounted on the ground plane 114. The lips 212, 222 may directly contact the ground plane 114 and screws may be inserted through the apertures 214, 224 to mount the decoupling units 200 to the panel 110. As the decoupling units 200 are formed of a conductive metal, each decoupling unit 200 is electrically connected to the ground plane 114. The sidewalls 210, 220, the top plate 230 and the ground plane 114 may define the internal cavity 240. The internal cavity 240 is open on each end thereof. In other embodiments, the decoupling units 200 may be electrically connected to the ground plane 114 by a contact structure.

When a signal is transmitted through the radiating elements 122 of one of the arrays (e.g., the first array 120), each of the radiating elements 122 will generate an electromagnetic field. Focusing, for example, on radiation element 122-4, this electromagnetic field may encompass one or more of the radiating elements 142 of the third array 140, such as radiating element 142-4, as typically the electromagnetic field generated by the radiating elements 122 will couple most strongly to the closest radiating element(s) in the adjacent array 140.

When the decoupling unit 200-1 is positioned between radiating elements 122-4 and 142-4, the electromagnetic field generated by radiating element 122-4 will generate surface currents on the conductive sidewalls 210, 220 and top plate 230 of the decoupling unit 200-1. When these currents are flowing, the decoupling unit 200-1 acts as a rectangular spatial cavity that alters the distribution of the electromagnetic field generated by radiating element 122-4. The surface currents may flow around the cavity 240. The decoupling unit 200-1 may be designed so that the change in the distribution of the electromagnetic field results in reduced electromagnetic field strength in the vicinity of the radiating element 142-4, and hence reduced cross coupling will occur from radiating element 122-4 to radiating element 142-4. Because the coupling is reduced, the negative impact that radiating element 142-4 has on the azimuth pattern of radiating element 122-4 may be reduced.

Figure 8A:
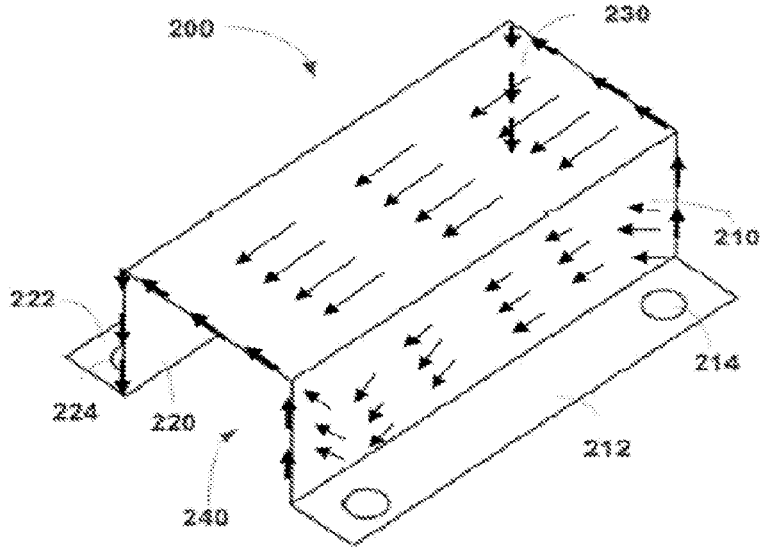
FIG. 8A is a perspective view of one of the decoupling units included in the antenna of FIGS. 3A-3D that illustrates the surface current distribution on the decoupling unit when an adjacent radiating element transmits a signal.
Figure 8B:
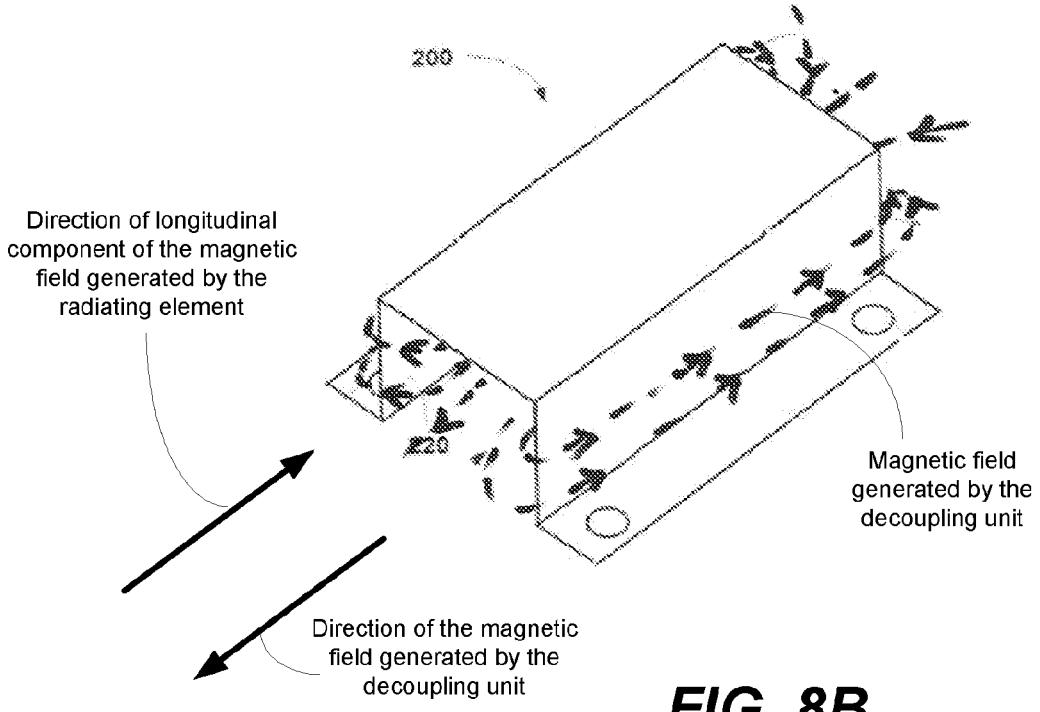
FIG. 8B is a perspective view of the decoupling unit of FIG. 8A that illustrates the magnetic field distribution that results from the surface currents.
Figure 8C:
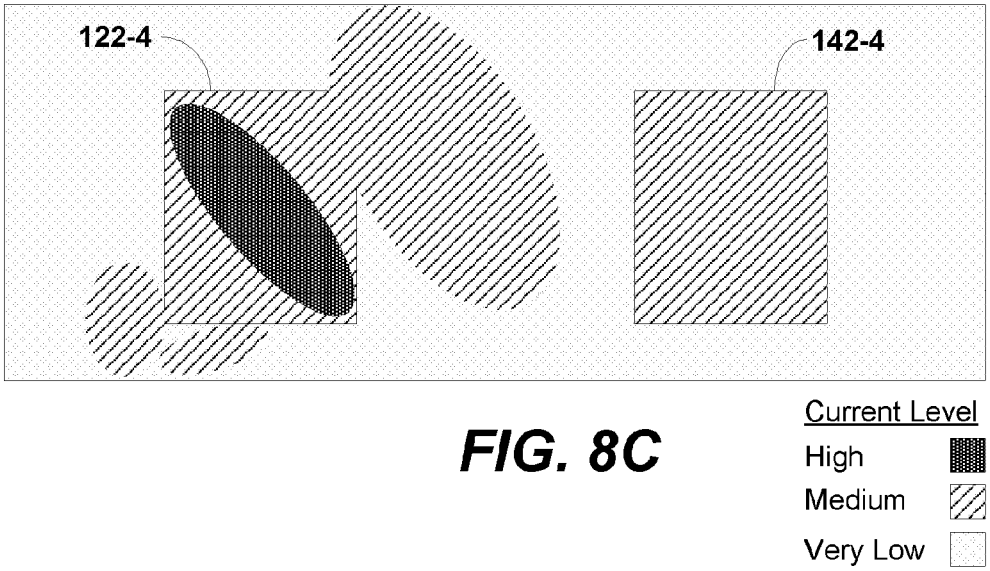
FIGS. 8C and 8D are schematic plan views illustrating the surface currents generated by a radiating element of a first array on a nearby radiating element of a second array when the decoupling unit of FIG. 8A is (FIG. 8D) and is not (FIG. 8C) provided between the radiating elements.
Figure 8D:
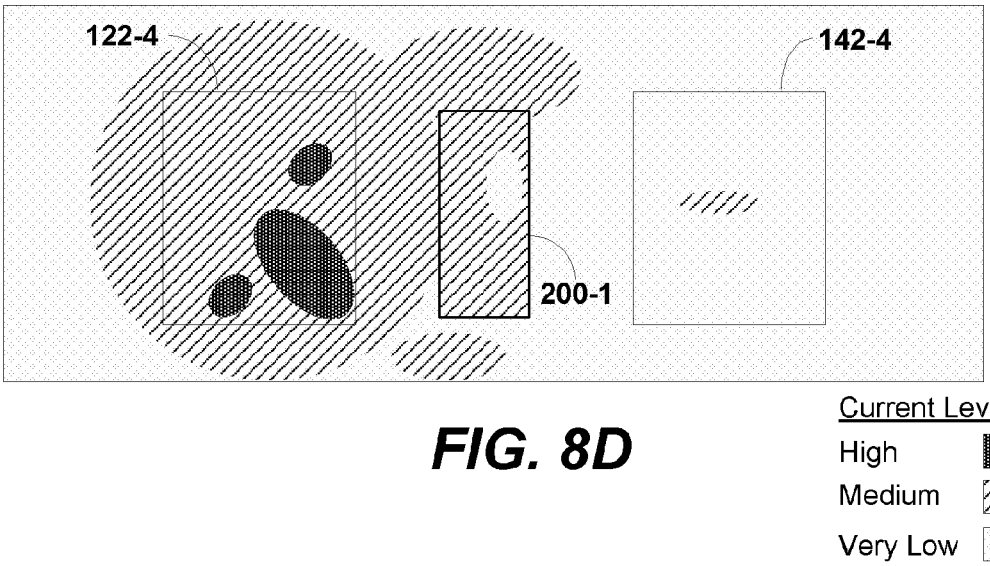

FIGS. 8A-8D illustrate in further detail how the decoupling unit 200 according to embodiments of the present invention may reduce cross coupling between closely located radiating elements of different arrays. In particular, FIG. 8A is a perspective view of one of the decoupling units 200-1 included on the antenna 300 of FIGS. 3A-3D that illustrates the surface current distribution on the decoupling unit 200-1 when an adjacent radiating element 122-4 (see FIG. 3A) transmits a signal. FIG. 8B is a perspective view of the decoupling unit 200-1 of FIG. 8A that illustrates the magnetic field distribution that results from the induced surface currents. FIGS. 8C and 8D are plan views illustrating the surface currents generated by radiating element 122-4 of a first array 120 on a radiating element 142-4 of a second array 140 when the decoupling unit 200-1 is omitted (FIG. 8C) as compared to when the decoupling unit 200-1 is provided between the radiating elements 122-4, 142-4 (FIG. 8D).

As shown in FIG. 8A, when radiating element 122-4 of phased array antenna 300 of FIGS. 3A-3D transmits a signal, surface currents are induced on the decoupling unit 200-1 which flow in the general directions shown by the arrows in FIG. 8A. The surface currents may, for example, originate at one side of the ground plane 114 (see FIG. 3A) near the decoupling unit 200-1, flow over the decoupling unit 200-1 as shown by the arrows in FIG. 8A, and come back across the ground plane 114 at the bottom side of the internal cavity 240.

As shown in FIG. 8B, the magnetic field that is generated by the surface currents on the decoupling unit 200-1 (see FIG. 8A) extends in a direction that is opposite the direction of the longitudinal component of the magnetic field generated by the radiating element 122-4. As a result, the magnetic field generated by the decoupling unit 200-1 reduces the field strength of the magnetic field of the radiating element 122-4 that cross couples to radiating element 142-4. FIGS. 8C and 8D are schematic diagrams that illustrate the effect that the magnetic field generated by the surface currents flowing on decoupling unit 200-1 has on the cross coupling from radiating element 122-4 to radiating element 142-4 by illustrating the levels of the surface currents that are induced on radiating element 142-4 as a result of cross coupling from radiating element 122-4. As shown in FIG. 8C, when the decoupling unit 200-1 is not present, the surface currents on radiating element 142-4 are at medium levels when radiating element 122-4 transmits a signal. As shown in FIG. 8D, when the decoupling unit 200-1 is inserted between the two radiating elements, a significant decrease in the surface current levels is seen. To put FIGS. 8C and 8D in context, the "medium" surface current levels may be about five times the "very low" surface current levels. Thus, FIGS. 8C and 8D show that the decoupling unit 200-1 may significantly reduce cross coupling from radiating element 122-4 to radiating element 142-4 (and vice versa when radiating element 142-4 is transmitting a signal). The frequency where the maximum decoupling effect occurs is determined by the physical dimensions of the decoupling unit 200-1.

As shown in FIGS. 3C and 3D, the height of the decoupling unit 200 may be less than the height of the radiating elements 132. This allows the decoupling units 200-1 through 200-3 to be positioned underneath the radiating elements 132, between the feed structures 134 of respective pairs of radiating elements 132. As can be seen in FIG. 3D, the radiating elements 132-3 and 132-4 each vertically overlap the decoupling unit 200-1. Herein, a first element of a flat panel phased array antenna "vertically overlaps" a second element of the flat panel antenna if an imaginary line exists that is perpendicular to the plane defined by the flat panel of the phased array antenna that intersects both the first element and the second element.

The height of each decoupling unit 200 may also be less than a height of the radiating elements 122 and 142 above the upper (front) surface of the flat panel 110. This can be seen graphically in FIG. 3C. Designing the height of the decoupling units 200 to be less than or equal to the height of the radiating elements 122, 142 may allow the decoupling units 200 to reduce cross coupling without otherwise negatively effecting the azimuth radiation pattern of the radiating elements 122, 142 in some embodiments.

In some embodiments, the lips 212, 222 of each decoupling unit 200 may be spaced between two and ten millimetres from the respective radiating elements 122, 142 that are disposed adjacent thereto. The sidewalls 210, 220 of each decoupling unit 200 may be spaced between ten and forty millimetres from the respective radiating elements 122, 142 that are disposed adjacent thereto.

The decoupling effect that decoupling unit 200-1 has on the cross-coupling between radiating elements 122-4 and 142-4 may be tuned by adjusting the length, width and/or height of the decoupling unit 200-1. Simulation software such as CST Studio Suite and HFSS may be used to select dimensions for the length, width and height that optimize performance of the antenna. Performance may then be further optimized by testing actual antennas with different decoupling unit designs.

While the phased array antenna 300 includes three decoupling units 200, it will be appreciated that more or fewer decoupling units 200 may be used. For example, in another embodiment, more than three decoupling units 200 may be used. A variety of factors may be used to select which pairs of horizontally aligned radiating elements 122, 142 from the arrays 120, 140 the decoupling units 200 are positioned between including the relative amplitudes of the signals transmitted by the radiating elements 122, 142, whether or not space exists on the antenna panel between the radiating elements (e.g., a radiating element 132 of the second array 130 may be in the position where the decoupling unit would be placed) and the amount of reduction in coupling between the arrays 120, 140 that is necessary to meet performance goals for the antenna 300. In some embodiments, decoupling units may be placed between radiating elements that transmit relatively higher amplitude signals.

Figure 4:
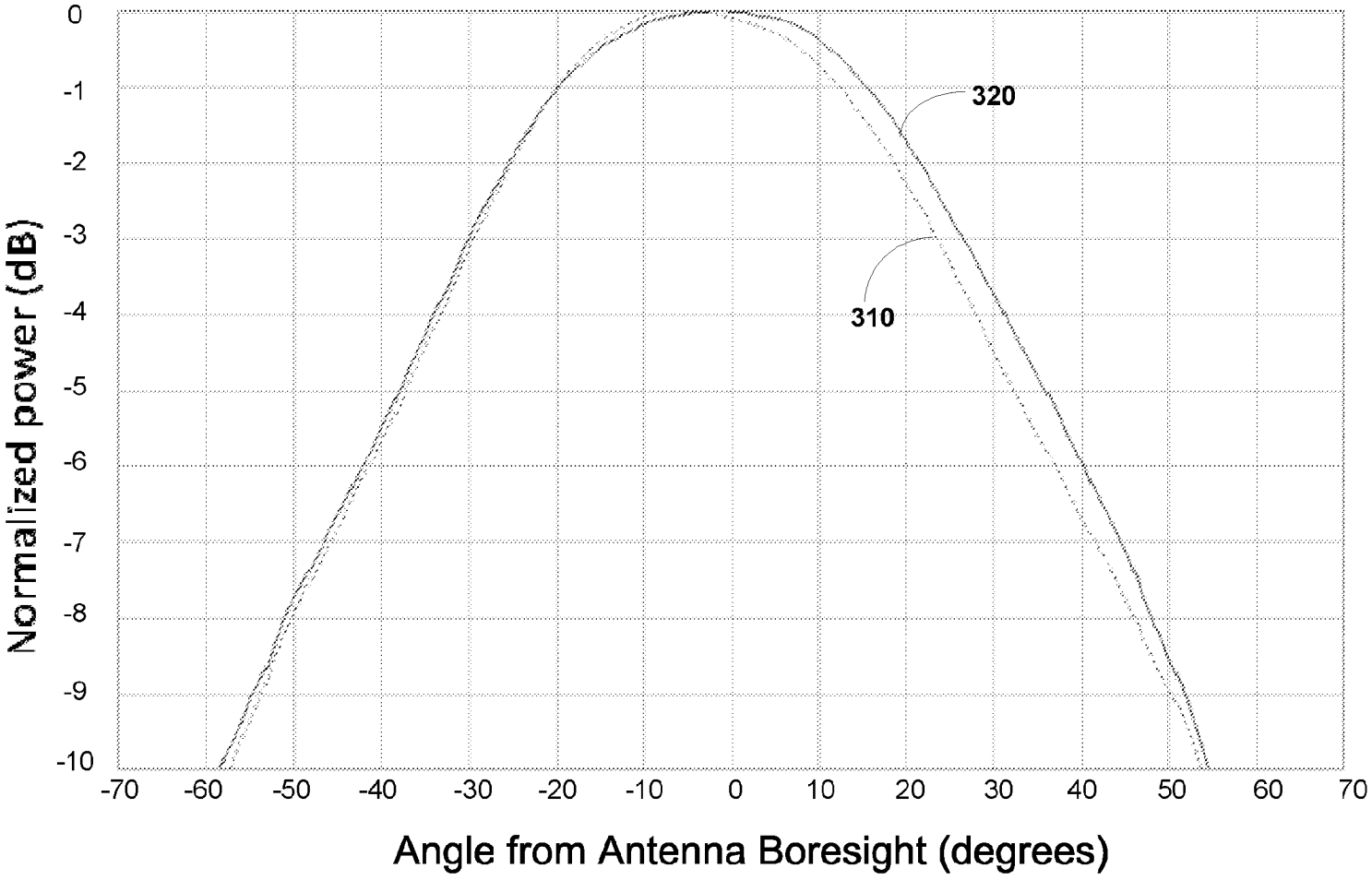
FIG. 4 is a graph comparing the azimuth beam pattern of the phased array antenna of FIGS. 1A-1B to the azimuth beam pattern of the phased array antenna of FIGS. 3A-3D.

FIG. 4 is a graph comparing the azimuth beam pattern of the phased array antenna 100 of FIGS. 1A-1B (which does not include the decoupling units 200) to the azimuth beam pattern of the phased array antenna 300 of FIGS. 3A-3D (which includes the decoupling units 200). Curve 310 shows the azimuth beam pattern of the phased array antenna 100 and curve 320 shows the azimuth beam pattern of the phased array antenna 300. As shown by curve 310 in FIG. 4, when the decoupling units 200 are omitted, the peak power of the antenna is offset from the boresight (zero degrees) to about −5 degrees, and the antenna pattern is less symmetrical. Additionally, the half power beam width of the phased array antenna 100 is only about 50 degrees, whereas the desired value is 60 degrees. In contrast, as shown by curve 320 in FIG. 4, when the decoupling units 200 are included, the peak power of the antenna is at about −1 degrees from the boresight, the antenna pattern has improved symmetry, and the half power beam width is increased to about 55 degrees.

Figure 5A:
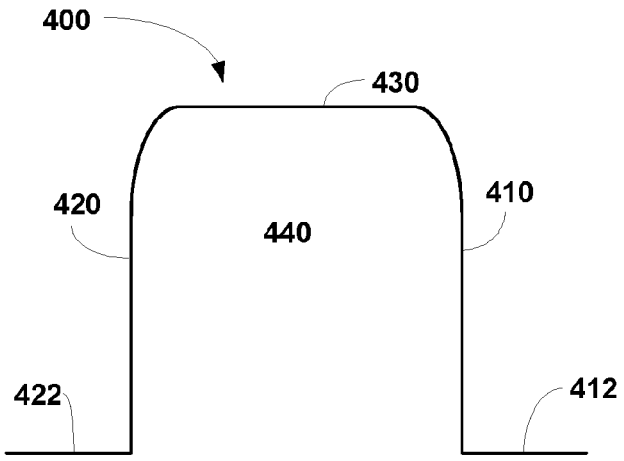
FIGS. 5A-5C are front views of decoupling units according to further embodiments of the present invention.
Figure 5B:
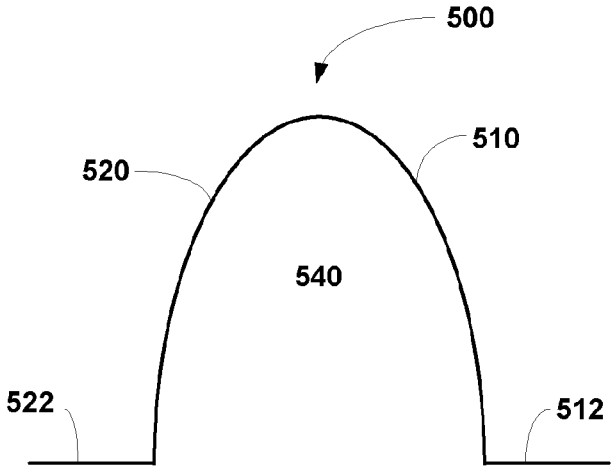
Figure 5C:
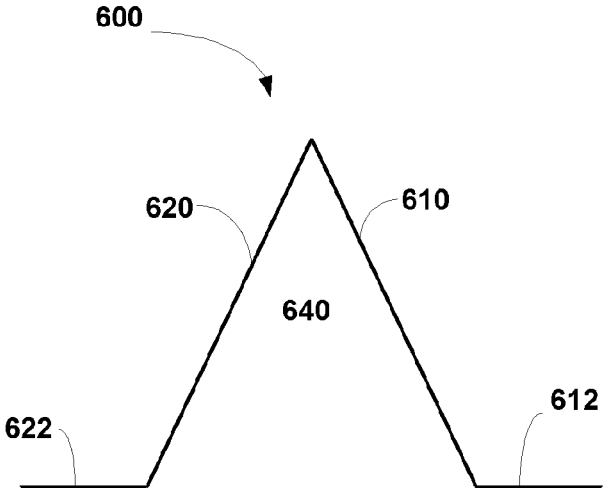

The decoupling unit 200 of FIGS. 2A-2B is just one example of a decoupling unit according to embodiments of the present invention that can be used to improve the performance of phased array antennas. For example, FIGS. 5A-5C are front views of decoupling units according to further embodiments of the present invention that could be used in place of the decoupling unit 200. The decoupling units illustrated in FIGS. 5A-5C may be identical to the decoupling unit 200 shown in FIGS. 2A-2D, except that the decoupling units in FIGS. 5A-5C have a different shaped cross-section (but otherwise can be the same length and height as the decoupling unit 200, have the same lips, etc.).

As shown in FIG. 5A, a decoupling unit 400 is similar to the decoupling unit 200, except that upper portions of the sidewalls 410, 420 of the decoupling unit 400 curve into the top plate 430. As shown in FIG. 5B, in another embodiment, a decoupling unit 500 is provided that has a semi-elliptical cross-section. The decoupling unit 500 may be viewed as having curved first and second sidewalls 510, 520 that meet so that no top plate is necessary to connect the sidewalls 510, 520. As shown in FIG. 5C, in yet another embodiment, a decoupling unit 600 is provided that has planar sidewalls 610, 620 that are slanted toward each other. In each case, the decoupling units 400, 500, 600 have respective internal cavities 440, 540, 640. Mounting and operation of the decoupling units 400, 500, 600 may be the same as the decoupling unit 200 and hence further description thereof will be omitted here. Each of the embodiments depicted in FIGS. 5A-5C have respective lips 412, 422; 512, 522; 612, 622 that may be identical to the lips 212, 222 of decoupling unit 200.

Figure 6:
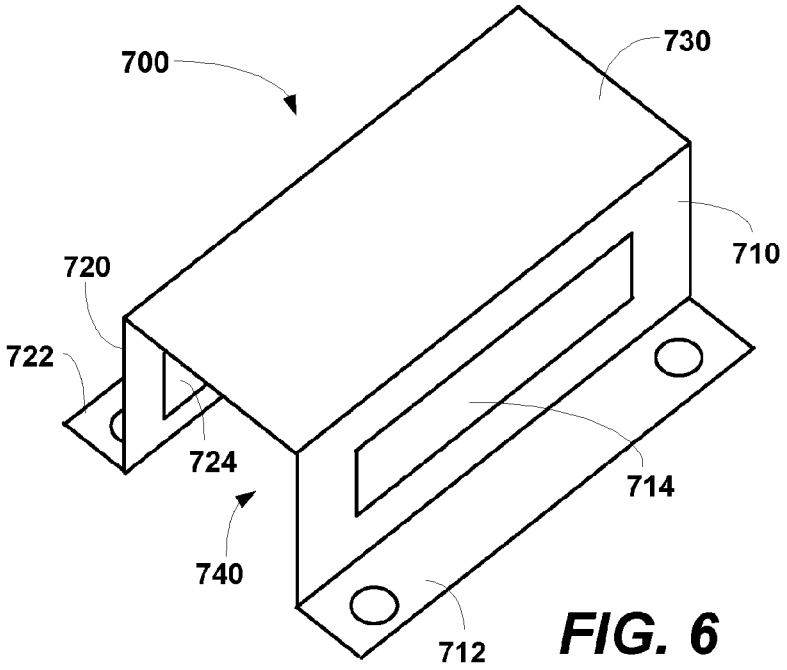
FIG. 6 is a perspective view of a decoupling unit according to still further embodiments of the present invention that includes tuning slots.

FIG. 6 is a perspective view of a decoupling unit 700 according to still further embodiments of the present invention that includes tuning slots. As shown in FIG. 6, the decoupling unit 700 may be almost identical to the decoupling unit 200, having sidewalls 710, 720, a top plate 730, an internal cavity 740 and lips 712, 722 that may be identical to the corresponding elements of decoupling unit 200, except that slots 714, 724 are included in the respective sidewalls 710, 720 thereof. The slots 714, 724 change the distribution of the surface currents that are generated on the sidewalls 710, 720 of decoupling unit 700 as compared to the surface currents that are generated on the sidewalls 210, 220 of the decoupling unit 200. As the surface currents on the decoupling unit 700 alter the distribution of the electromagnetic field, the number and location of the slots 714, 724 may be selected to further reduce the strength of the electromagnetic field generated by one of the radiating elements 122 on an adjacent radiating element 142, and vice versa. The slots 714, 724 may significantly reduce the amount of cross coupling.

Figure 9A:
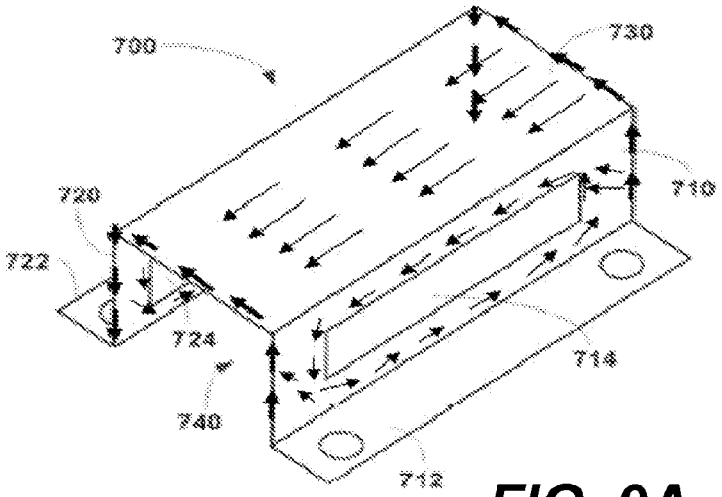
FIG. 9A is a perspective view of the decoupling unit of FIG. 6 that illustrates the surface current distribution on the decoupling unit when an adjacent radiating element transmits a signal.

FIG. 9A is a perspective view of the decoupling unit 700 of FIG. 6 that illustrates the surface current distribution on the decoupling unit 700 when an adjacent radiating element (not shown) transmits a signal. As shown by the arrows in FIG. 9A, the surface currents that are induced on the decoupling unit 700 flow in a circle around the slot 714 (and also flow in a circle around the slot 724 which is barely visible in FIG. 9A). As is readily apparent by comparing FIGS. 8A and 9A, the slots 714, 724 may significantly alter the path of the surface currents. The flow of current around the slots 714, 724 creates an additional magnetic field component across the decoupling unit 700 which is in addition to the longitudinal component described above with respect to FIG. 8B. The additional magnetic field component further reduces the coupled fields generated by the radiating elements in the transverse direction (i.e., in the direction from radiating element 122-4 to radiating element 142-4 in FIG. 3A). This further improves the decoupling effect provided by the decoupling unit 700. The magnitude of the transverse magnetic field, and hence the decoupling effect that the magnetic field will achieve, depends on the dimensions of the slots 714, 724. In some embodiments, the slots 714, 724 may have a height that is between $0.02\lambda$ and $0.08\lambda$ where $\lambda$ is the wavelength corresponding to a first frequency where a coupling between the first and second arrays in the absence of the decoupling unit reaches a maximum value. The first frequency where the coupling between the first and second arrays in the absence of the decoupling unit reaches a maximum value corresponds to the frequency that shows maximum perturbations in the radiation patterns (i.e., the frequency where the radiation pattern of the first array when operated adjacent to the second array shows the greatest change as compared to the radiation pattern of the first array when operated without the second array present). The slots 714, 724 may have a length between 0.2λ and 0.6λ in some embodiments. Typically, a larger slot will produce a magnetic field having increased magnitude. However, a magnetic field with increased magnitude is not always favorable as the magnetic field itself can create unwanted perturbations in the radiation patterns. Simulations may be used to optimize the dimensions of the slot to reduce the overall impact on the radiation pattern.

Figure 9B:
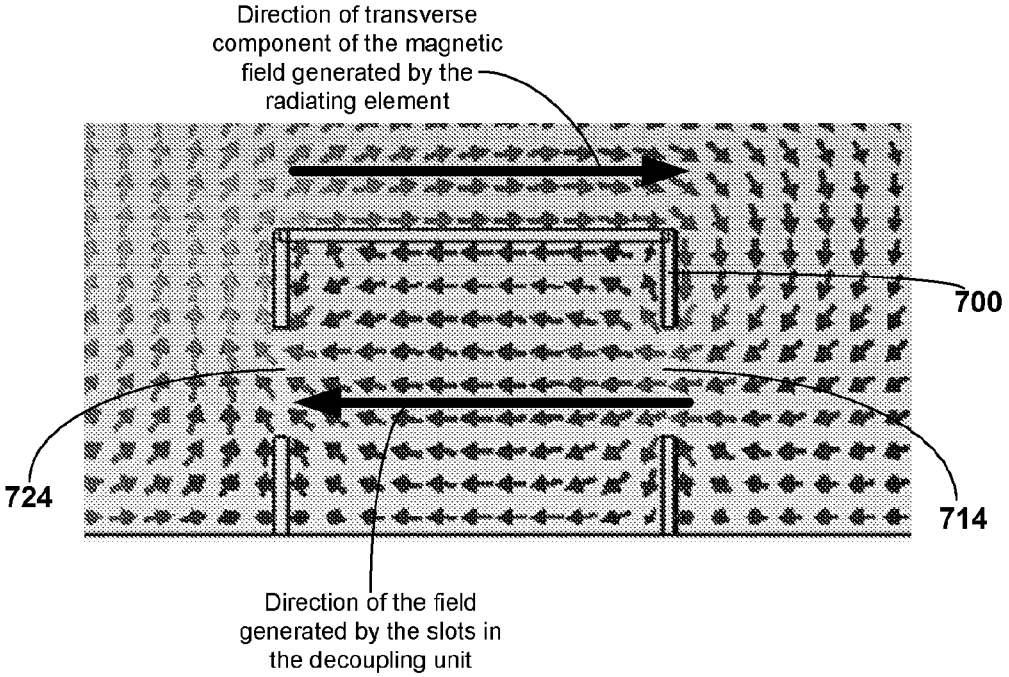
FIG. 9B is a cross-sectional view of the decoupling unit of FIG. 6 that illustrates the magnetic field distribution in the transverse direction.

FIG. 9B is a cross-sectional view of the decoupling unit 700 having slots 714, 724 that illustrates the magnetic field distribution in the transverse direction. As shown in FIG. 9B, the direction of the resultant field that is generated due to the slots 714, 724 in the decoupling unit 700 is opposite the direction of the transverse component of the magnetic field that is generated by the radiating element. As such, the field generated by the slots 714, 724 acts to reduce the transverse component of the magnetic field that is generated by the radiating element.

Figure 7:
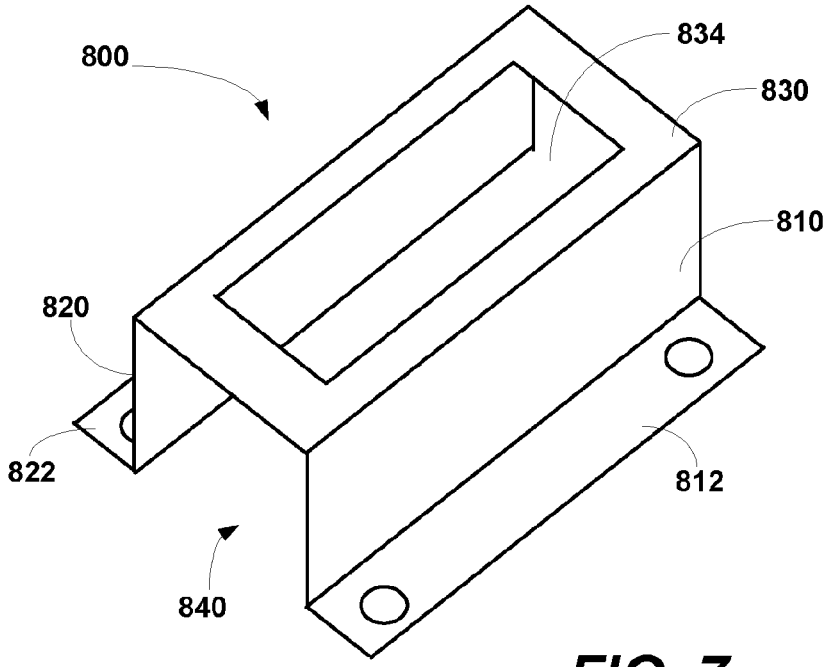
FIG. 7 is a perspective view of a decoupling unit according to yet another embodiment of the present invention.

FIG. 7 is a perspective view of a decoupling unit 800 according to yet another embodiment of the present invention. As shown in FIG. 7, the decoupling unit 800 may be identical to the decoupling unit 200, except that a slot 834 is included in the top plate 830 thereof. Like the slots 714, 724 included in the respective sidewalls 710, 720 of decoupling unit 700, the slot 834 changes the distribution of the surface currents that are generated on the decoupling unit 800 as compared to the surface currents that are generated on the decoupling unit 200. The number, shape, size and location of the slot(s) 834 may be selected to further reduce the strength of the electromagnetic field generated by one of the radiating elements 122 on an adjacent radiating element 142, and vice versa, in order to reduce cross coupling therebetween.

Referring again to FIGS. 3A-3D, it can be seen that the radiating elements 132 are interposed between the radiating elements 122 and the radiating elements 142, and hence a radiating element 132 is closer to each radiating element 122 than is a radiating element 142. Consequently, it might be expected that the radiating elements 132 would have an even stronger impact on the azimuth radiation pattern of the radiating elements 122 than would the radiating elements 142. However, the radiating elements 132 are designed to operate in a different frequency band, and hence the cross coupling tendency may be reduced between radiating elements 122 and 132.

As discussed above, the surface currents that are generated on the decoupling units according to embodiments of the present invention may flow around the cavity thereof (e.g., the cavity 240 of the decoupling unit 200 of FIGS. 2A-2B), and these currents alter the distribution of the electromagnetic field generated by radiating elements (e.g., radiating elements 122-4 and 142-4 for the decoupling unit 200-1 of FIGS. 3A-3D) adjacent thereto in a manner that reduces cross coupling between closely positioned radiating elements of different arrays. In the decoupling units 200 that are included in the phased array antenna 300 of FIGS. 3A-3D, three sides of the cavity are formed by the sidewalls 210, 220 and top plate 230 of the decoupling unit 200 and the fourth side of the cavity 240 is formed by the conductive ground plane 114. In other embodiments, the decoupling unit may form all sides of the internal cavity thereof. For example, in another design, the decoupling unit 200 could be modified to include a base plate that extends between the lower edges of the sidewalls 210, 220 so that walls of the decoupling unit form all four sides of the internal cavity thereof.

The decoupling units according to embodiments of the present invention may work by diverting a portion of the electromagnetic field generated by a radiating element toward the decoupling unit as opposed to toward a radiating element of another array. The decoupling unit may be designed so that it has less impact on the azimuth radiation pattern than the nearby radiating element of an adjacent array.

As noted above, the length, width and height of the decoupling units according to embodiments of the present invention may be varied to enhance the performance thereof. In some embodiments, the width of the decoupling unit may be between 0.2 and 0.35 of the wavelength at the first frequency where coupling between the first and second arrays in the absence of the decoupling unit reaches a maximum value, the height of the decoupling unit may be between 0.1 and 0.35 of the wavelength at the first frequency, and the length of the decoupling unit may be between 0.45 and 0.65 of the wavelength at the first frequency.

The decoupling units according to embodiments of the present invention may be very effective at reducing cross-coupling between the radiating elements of two closely spaced apart linear phased arrays that operate in the same frequency band. It will be appreciated, however, that coupling may also occur between closely-spaced radiating elements of two different arrays that operate at different frequency bands. For example, the phased array antenna of FIGS. 1A-1B includes a second array 130 that is positioned between first and third arrays 120, 140. In the depicted embodiment, the first and third arrays 120, 140 are designed to operate in the 1695-2690 MHz frequency range, while the second array 130 is designed to operate in the 694-960 MHz frequency range. While the radiating elements 122, 132 of arrays 120 and 130 will tend to cross-couple less than the radiating elements 122, 142 of arrays 120 and 140 because of the different operating frequency ranges, the radiating elements 122 of array 120 are closer to the radiating elements 132 of array 130 than they are to the radiating elements 142 of array 140. The smaller separation tends to increase the amount of cross-coupling. Decoupling structures may be placed between the radiating elements 122 and 132 and/or between the radiating elements 132 and 142 in further embodiments.

It will be appreciated that numerous variations may be made to the phased array antennas and decoupling units disclosed herein without departing from the scope of the present invention. For example, the phased array antenna 300 includes eleven radiating elements in each high band array, but only includes three decoupling units. It will be appreciated that in other embodiments more or less decoupling units could be provided. In some alternative embodiments, a total of eleven decoupling units could be provided, where each decoupling unit is positioned between the two radiating elements in a row of the 11×2 array formed by the two high band arrays. It will also be appreciated that the decoupling units could be made longer so that they can be interposed between the radiating elements in multiple of the rows of the above-described 11×2 array. As one simple example, a single decoupling unit could be provided between arrays 120 and 140 that has a length that is about the same as the length of the arrays 120, 140 that is interposed between the two arrays 120, 140. Such a decoupling unit would need to either include openings that the radiating elements 132 of the low band array 130 extend through or be used on a phased array antenna that did not include the low band array 130.

The present invention has been described above with reference to the accompanying drawings, in which certain embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A base station antenna, comprising:

a panel that includes a ground plane;

at least a first array that includes a first plurality of linearly arranged radiating elements and a second array that includes a second plurality of linearly arranged radiating elements mounted on the panel; and a plurality of decoupling units positioned between the first array and the second array, wherein each decoupling unit includes at least a first sidewall that faces a respective one of the radiating elements of the first array, a second sidewall that faces a respective one of the radiating elements of the second array and an internal cavity that is defined in the region between the sidewalls, and wherein the first and second sidewalls of each of the decoupling units are each electrically conductive and are electrically connected to the ground plane.

2. The base station antenna of claim 1, wherein the first array is configured to operate in a first frequency range and the second array is configured to operate in the first frequency range.

3. The base station antenna of claim 1, further comprising a third array that includes a third plurality of radiating elements, the third array being positioned between the first array and the second array and configured to operate in second frequency range that is different from the first frequency range.

4. The base station antenna of claim 3, wherein the decoupling unit is between the first radiating element of the first array and the first radiating element of the second array along a first direction and is between a first radiating element of the third array and a second radiating element of the third array along a second direction that is substantially perpendicular to the first direction.

5. The base station antenna of claim 4, wherein at least one of the first and second radiating elements of the third array vertically overlaps the decoupling unit.

6. The base station antenna of claim 4, wherein the decoupling unit has a width in the first direction of between 0.2 and 0.35 a wavelength of a first frequency in the first frequency range where a coupling between the first and second arrays in the absence of the decoupling unit reaches a maximum value, has a length in the second direction that is between 0.45 and 0.65 the wavelength of the first frequency, and has a height in a third direction that is perpendicular to both the first direction and the second direction that is between 0.1 and 0.35 the wavelength of the first frequency.

7. The base station antenna of claim 3, wherein the decoupling unit is underneath both the first and second radiating elements of the third array.

8. The base station antenna of any of claim 3, wherein a first radiating element of the third, array extends through an opening in the decoupling unit.

9. The base station antenna of claim 1, wherein the decoupling unit has a generally U-shaped cross section.

10. The base station antenna of claim 1, wherein the first sidewall has a lip that extends outwardly from a lower edge of the first sidewall the lip extending parallel to the reflector.

11. The base station antenna of claim 1, wherein the first sidewall includes a slot-shaped opening.

12. The base station antenna of claim 11, wherein a height of slot-shaped opening in a direction perpendicular to a plane defined by the ground plane is between 0.02λ and 0.08λ where λ is a wavelength corresponding to a first frequency in the first frequency range where a coupling between the first and second arrays in the absence of the decoupling unit reaches a maximum value.

13. The base station antenna of claim 12, wherein a length of slot-shaped opening in a direction parallel to the plane defined by the ground plane is between 0.2λ and 0.6λ.

14. The base station antenna of claim i, wherein the decoupling unit further includes a top plate that connects an upper edge of the first sidewall to an upper edge of the second sidewall.

15. The base station antenna of claim 14, wherein, the top plate includes at least one slot.

16. The base station antenna of claim 1, wherein a height of the decoupling, unit above the ground plane is less than a height of the first radiating element of the first array above the ground plane and a height of the first radiating element of the second array above the ground plane.

17. The base station antenna of claim 1, wherein the decoupling unit, also is positioned between a second radiating element of the first array and a second radiating element of the second array.

18. A decoupling unit that is configured to reduce cross coupling between a first radiating element of a first linear array of a phased array antenna and a second radiating element of a second linear array of the phased array antenna, the decoupling unit comprising;

a first sidewall;

a second sidewall opposite the first sidewall;

a top plate that connects an upper edge of the first sidewall to an upper edge of the second sidewall;

an internal cavity defined by at least the first sidewall, the second sidewall and the top plate;

wherein the top plate has a width in a first direction that extends between the first and second sidewalls of between 0.2 and 0.35 a wavelength of a first, frequency in tire frequency range of operation of the first radiating element where a coupling between the first and second linear arrays in the absence of the decoupling unit reaches a maximum value, the top plate has a length 'dun is between 0.45 and 0.65 the wavelength of the first frequency, and the first and second sidewalls have a height that is between 0.1 and 0.35 the wavelength of the first frequency.

19. The decoupling unit of claim 18, wherein the decoupling unit has a generally U-shaped cross section.

20. The decoupling unit of claim 18, wherein the first sidewall has a first lip that extends outwardly from a lower edge of the first sidewall, and the second sidewall has a second lip that extends outwardly from a lower edge of the second sidewall.

* * * * *